US005135458A

United States Patent [19]

Huang

[11] Patent Number: 5,135,458

[45] Date of Patent: Aug. 4, 1992

[54] MULTI-FUNCTIONAL EXERCISING DEVICE

[76] Inventor: Chin C. Huang, No. 67-1, Yunghua Rd., Tainan, Taiwan

[21] Appl. No.: 746,856

[22] Filed: Aug. 19, 1991

[51] Int. Cl.[5] ..... A63B 21/00

[52] U.S. Cl. ..... 482/138; 482/38; 482/51; 482/54; 482/57; 482/72; 482/908

[58] Field of Search ..... 482/38, 51, 54, 57, 482/58, 59, 62, 72, 73, 74, 112, 113, 129, 130, 133, 138, 908

[56] References Cited

U.S. PATENT DOCUMENTS

| | | | |
|---|---|---|---|
| 3,752,473 | 8/1973 | LaLanne | 482/38 |
| 4,354,675 | 10/1982 | Barclay et al. | 482/138 X |
| 4,390,179 | 6/1983 | Szkalak | 482/138 X |
| 4,564,193 | 1/1986 | Stewart | 482/138 X |
| 4,781,374 | 11/1986 | Lederman | 482/102 X |
| 4,784,384 | 11/1988 | Deola | 482/138 X |
| 4,880,227 | 11/1989 | Sowell | 482/138 X |
| 4,900,018 | 2/1990 | Ish, III et al. | 482/138 |
| 4,909,504 | 3/1990 | Yang | 482/908 X |

FOREIGN PATENT DOCUMENTS

| | | | |
|---|---|---|---|
| 2630652 | 11/1989 | France | 482/138 |
| 1477433 | 5/1989 | U.S.S.R. | 482/138 |
| 2163358 | 2/1986 | United Kingdom | 482/133 |

*Primary Examiner*—Robert Bahr
*Attorney, Agent, or Firm*—Beehler & Pavitt

[57] ABSTRACT

A multi-functional exercising machine includes a main structure, a jogging device, a rowing device, a stationary bicycle, a pulling spring, a shelf, a stand, a chair, and a pull-up bar. The stand is attached to the main structure while standing on the jogging device. The chair or the pull-up bar is attachable to the stand.

3 Claims, 5 Drawing Sheets

MULTI-FUNCTIONAL EXERCISING DEVICE

BACKGROUND OF THE INVENTION

The present invention relates to a multi-functional exercising device, particularly to a multi-functional exercising device which includes a stand, so that a pull-up bar or a chair is attachable thereto.

Conventionally, a multi-functional exercising device includes a jogging assembly, a rowing assembly, a stationary bicycle, a pulling spring, and a shelf. Although, an exerciser can have various exercises with such a device, he cannot exercise his waist, nor can he do pull-ups with such a device.

Therefore, the present invention is intended to obviate the above problems.

SUMMARY OF THE INVENTION

It is an object of the present invention to provide a multi-functional exercising device which includes a stand to which a pull-up bar or a chair is attachable, so that an exercise can exercise his waist or do pull-ups therewith.

This and additional objects, if not specifically set forth herein, will be readily apparent to those skilled in the art from the detailed description of embodiments below, with reference of the accompanying drawings.

DESCRIPTION OF THE INVENTION

Figure 1:
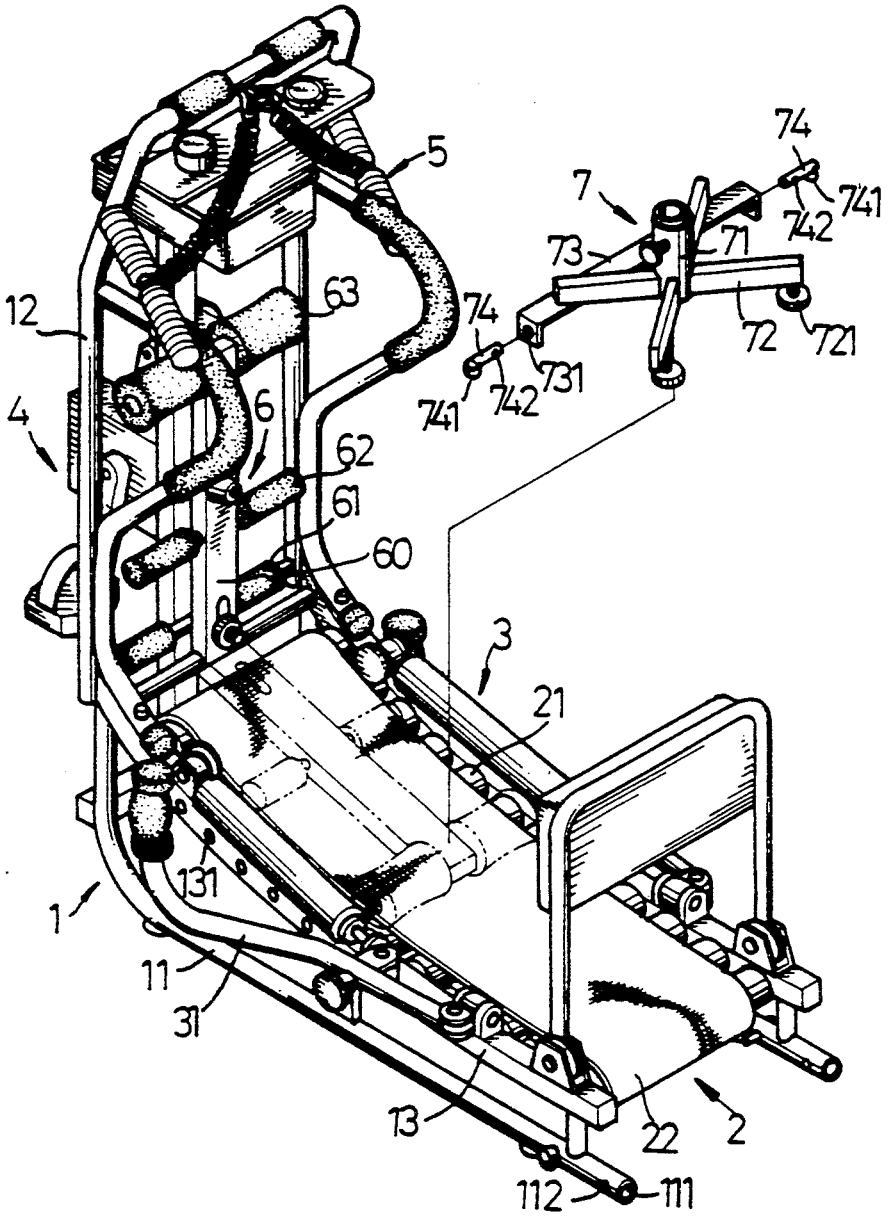
FIG. 1 is a perspective exploded view of a multi-functional exercising machine, showing a stand before engaging with the exercising machine in accordance with a preferred embodiment of the present invention.

Referring to FIG. 1, a multi-functional exercising machine includes a main structure 1, a jogging device 2, a rowing device 3, a stationary bicycle 4, a pulling spring 5, a shelf 6, and a stand 7.

The main structure 1 includes two horizontal tubes 11, two vertical tubes 12 each being fixed to a tube 11, and two inclined bars 13 each residing above a horizontal tube 11. Each tube 11 includes an end 111 and a hole 112. Each of the inclined bars 13 includes a plurality of holes 131.

The jogging device 2 includes a plurality of rollers 21 mounted on the inclined bar 13 and a belt 22.

The rowing device 3 includes two oars 31 each mounted on a bar 13.

The stationary bicycle 4 is arranged between the tubes 12.

The shelf 6 includes a beam 60, a first pair of ribs 61, a second pair of ribs 62, and a third pair of ribs 63. The beam 60 is pivotally mounted on the inclined bars 13. The ribs are all attached perpendicularly to the beam 60. The shelf 6 is arranged in a first position where the beam 60 stands parallel to the tubes 12 or in a second position where the beam 60 lies on the belt 22, as shown in phantom line.

The stand 7 includes a cylinder 71 defining a threaded hole 711 and four legs 72 fixed below the cylinder 71. Two adjacent legs 72 are each formed with a pad 721, while other two legs 72 are attached to a strip 73 including two bent ends each defining a hole 731. A pin 74 includes a first end formed with a ring 741 and a second end formed with a recess in which a spring and a ball detent 742 is received. The pin 74 is inserted through a hole 731 and a corresponding hole 131, thereby fixing the stand 6 to the main structure 1.

Figure 2:
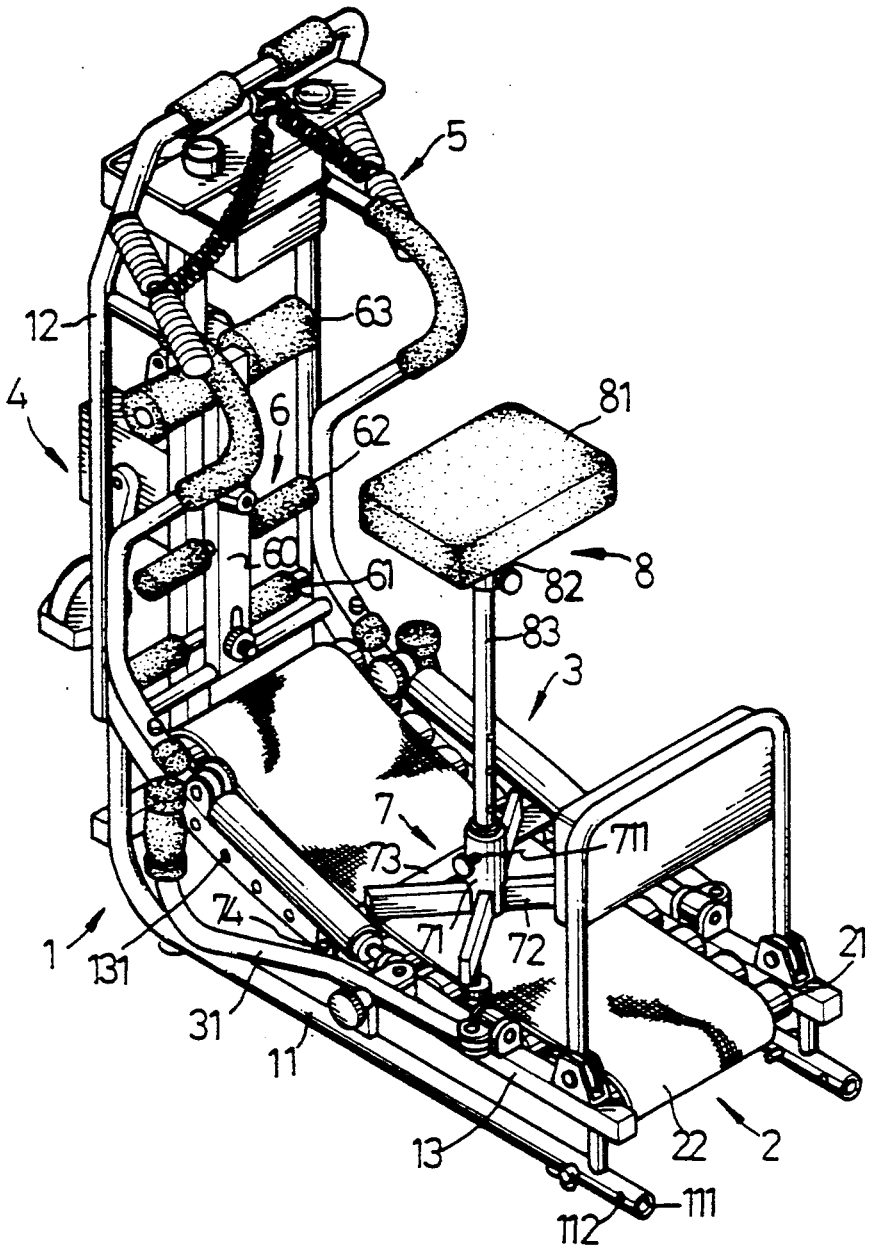
FIG. 2 is a perspective view of a multi-functional exercising machine, showing a stand and a chair engaging with the exercising machine, in accordance with a preferred embodiment of the present invention.

Referring to FIG. 2, the chair 8 includes a seat 81, an engaging means 82 fixed below the seat 81, and a post 83. The engaging means 82 engages the post 83 with the seat 81. The post 83 fits in the cylinder 71. A threaded bolt is screwed through the threaded hole 711, thereby securing the post 83 to the stand 7.

When the shelf 6 is in the first position, an exerciser sits on the chair 8 with his feet hooked on the pair of ribs 63, so that the exerciser can do hyperextended sit-ups. When the shelf 6 is in the second position, an exerciser sits on the chair 8 and rides the stationary bicycle 4.

Figure 3:
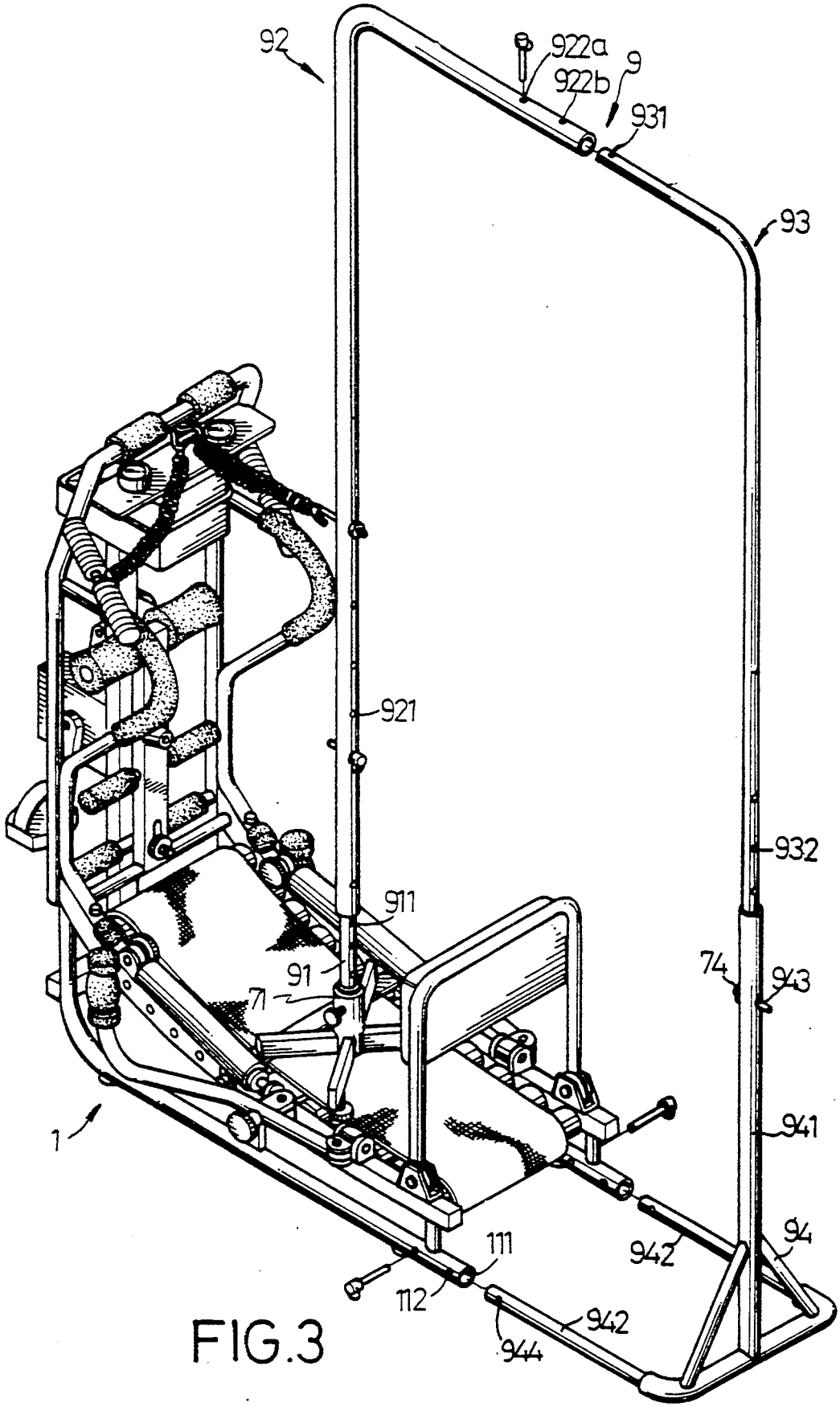
FIG. 3 is a perspective view of a multi-functional exercising machine, showing a stand and a pull-up bar engaging with the exercising machine in accordance with a preferred embodiment of the present invention.

Referring to FIG. 3, a pull-up bar 9 includes a rod 91, an L-shaped tube 92, an L-shaped rod 93, and an auxiliary stand 94. The rod 91 includes a plurality of holes 911 and fits in the cylinder 71. Then, a threaded bolt is screwed through the threaded hole 711, thereby securing the rod 91 to the stand 7.

The L-shaped tube 92 includes a first end within which the rod 91 fits and a second end. The L-shaped tube 92 has a plurality of holes 921 and two holes **922*a* and 922*b*. A pin 74 is inserted through a hole 921 and a corresponding hole 911, thereby securing the tube 92 to the rod 91. The L-shaped rod 93 includes a first end which is inserted in the second end of the L-shaped tube 92 and a second end. The L-shaped rod 93 comprises a hole 931 and a plurality of holes 932. A pin 74 is inserted through the hole 924*b* and the hole 931, thereby attaching the L-shaped rod 93 to the L-shaped tube 92**.

The auxiliary stand 94 includes a tube 941 and two rods 942 each corresponding to the end 111 of the horizontal tube 11. The tube 941 includes a hole 943. The rod 942 includes a hole 944. The second end of the L-shaped rod 93 is inserted in the tube 941. A pin 74 is inserted through the hole 943 and one of the holes 932, thereby attaching the rod 93 to the auxiliary stand 94. Each rod 942 is inserted in the end 111 of the tube 11. A pin 74 is inserted through the hole 112 and the hole 944, thereby securing the auxiliary stand 94 to the main structure 1.

Figure 4:
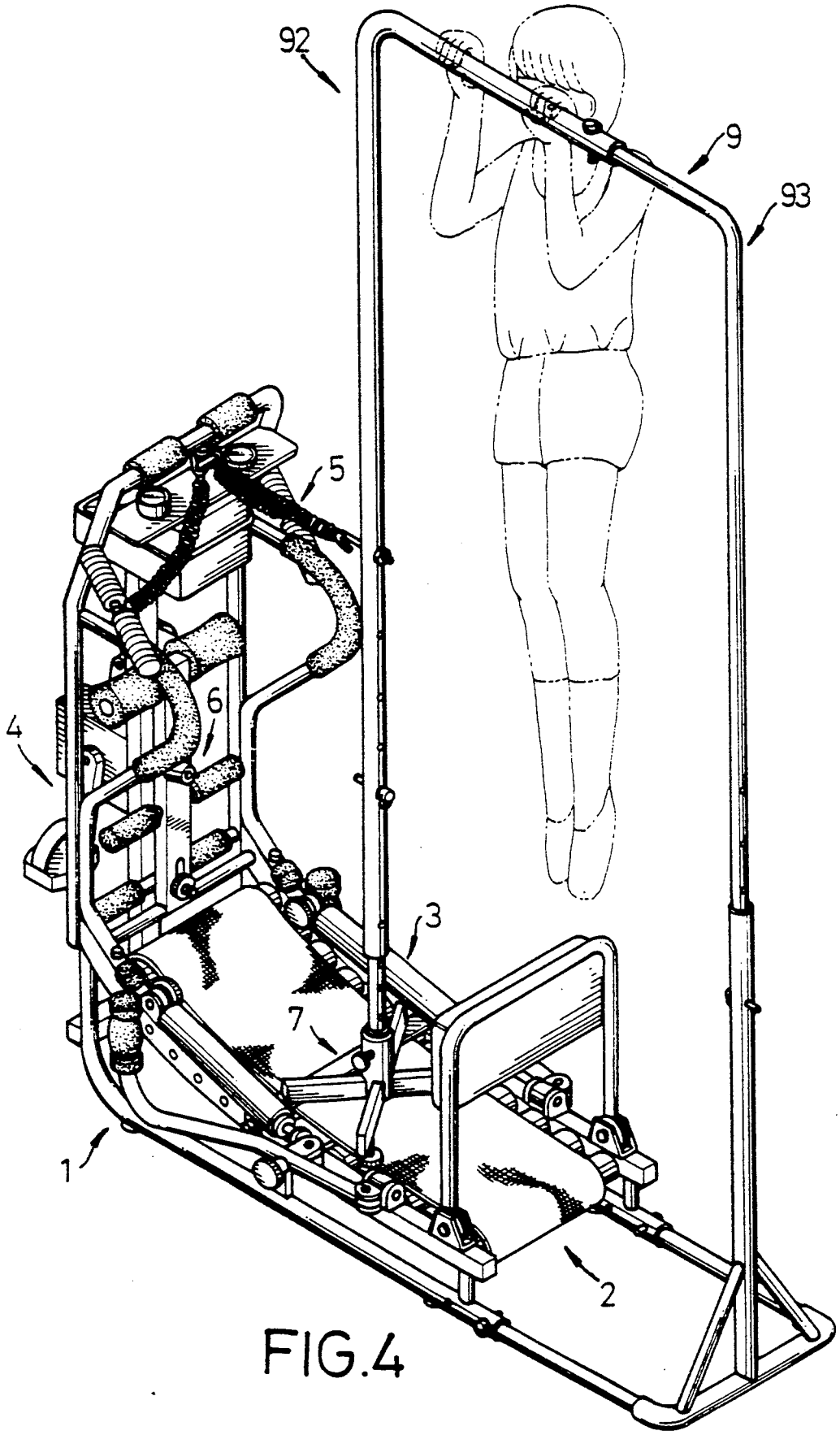
FIG. 4 is a perspective view of a multi-functional exercising machine, showing an exerciser doing a pull-up, in accordance with a preferred embodiment of the present invention.

Referring to FIG. 4, an exerciser (shown in phantom line) is doing a pull-up.

Figure 5:
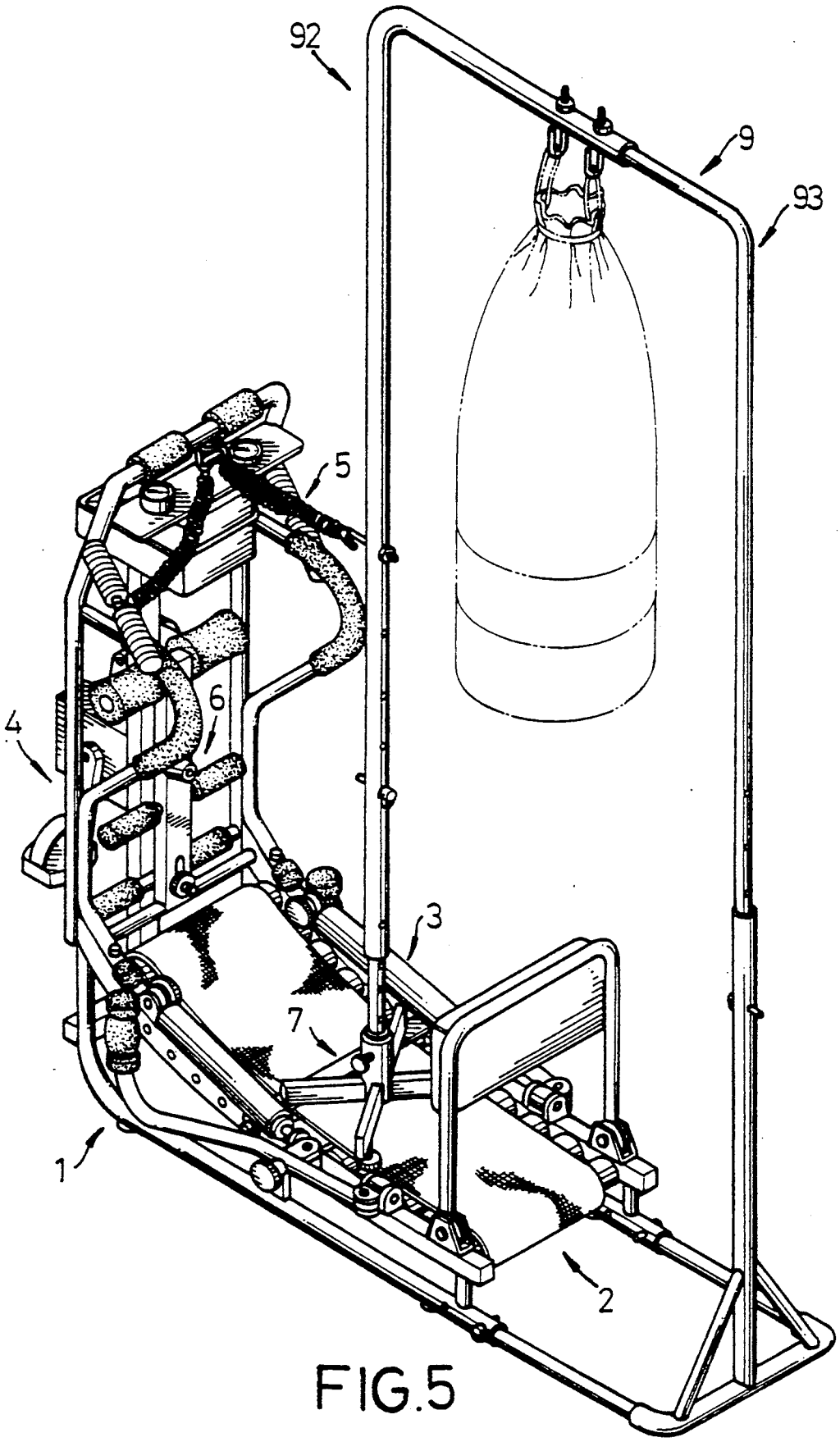
FIG. 5 is a perspective view of a multi-functional exercising machine, showing a punching bag hung on a pull-up bar, in accordance with a preferred embodiment of the present invention.

Referring to FIG. 5, two hooks each include a threaded portion. The threaded portions of the hooks are inserted respectively through holes **924*a* and 924*b* and engage with a nut, thus securing the hooks to the pull-up bar 9**. A punching bag is hung on the hooks. An exerciser can practice boxing on the punching bag.

While the present invention has been explained in relation to its preferred embodiment, it is to be understood that various variations thereof will be apparent to those skilled in the art upon reading this specification. Therefore, the invention disclosed herein is intended to cover all such variations as shall fall within the scope of the appended claims.

What I claim is:

1. A multi-functional exercising machine including a main structure, a jogging device, a rowing device, a stationary bicycle, a pulling spring, a shelf, a stand, a chair, and a pull-up bar, the improvements comprising:

said main structure including two inclined bars each including a plurality of corresponding holes and two horizontal tubes each residing below one of said inclined bars;

said stand including a cylinder defining a threaded hole, two adjacent supporting legs and two adjacent engaging legs, each said leg being fixed below said cylinder, a pad being fixed below each said supporting leg, and a strip being fixed below said engaging legs and including two bent ends each defining a hole; and a pin being insertable through each said hole of said strip and a corresponding said hole of each said inclined bar, thereby attaching said stand to said main structure.

2. A multi-functional exercising machine in accordance with claim 1, wherein said chair includes a seat and a post, said post being fixed below said seat and fitting in said cylinder.

3. A multi-functional exercising machine in accordance with claim 1, wherein said pull-up bar includes:

a first end insertable in said cylinder of said stand;

a second end; and an auxiliary stand including a cylinder within which said second end of said pull-up bar is insertable and two horizontal rods each being insertable in one of said horizontal tubes, thereby securing said pull-up bar to said main structure.

* * * * *